US006732387B1

(12) United States Patent
Waldron

(10) Patent No.: US 6,732,387 B1
(45) Date of Patent: May 11, 2004

(54) AUTOMATED PEDICURE SYSTEM

(75) Inventor: Mark Waldron, Sleepy Hollow, IL (US)

(73) Assignee: Belvedere USA Corporation, Belvedere, IL (US)

( * ) Notice: Subject to any disclaimer, the term of this patent is extended or adjusted under 35 U.S.C. 154(b) by 0 days.

(21) Appl. No.: 10/455,547

(22) Filed: Jun. 5, 2003

(51) Int. Cl.[7] ..... A47K 3/022; A61H 35/00; E03C 1/00

(52) U.S. Cl. ..... 4/622; 4/541.2

(58) Field of Search ..... 4/621, 622, 541.1, 4/541.2; 601/157

(56) References Cited

U.S. PATENT DOCUMENTS

| | | | | |
|---|---|---|---|---|
| 3,939,825 A | | 2/1976 | Krummenacher | |
| 4,075,457 A | | 2/1978 | Williams | |
| 4,086,669 A | | 5/1978 | Combis | |
| 4,497,313 A | | 2/1985 | Kurosawa | |
| 4,620,529 A | | 11/1986 | Kurosawa | |
| 4,742,456 A | * | 5/1988 | Kamena | 4/541.2 |
| 4,979,245 A | | 12/1990 | Gandinia | |
| 5,224,224 A | | 7/1993 | Hintz et al. | |
| 5,729,841 A | | 3/1998 | Chan | |
| 5,862,545 A | | 1/1999 | Mathis et al. | |
| 6,199,224 B1 | | 3/2001 | Versland | |
| 6,357,060 B2 | | 3/2002 | Gloodt | |

* cited by examiner

*Primary Examiner*—Tuan N. Nguyen
(74) *Attorney, Agent, or Firm*—Fitch, Even, Tabin & Flannery

(57) ABSTRACT

A pedicure treatment system includes a receptacle for immersion treatment with jet action. A recirculating circuit is coupled to a source of sanitizing agent through a metering pump. Different automated sanitizing modes are carried out according to programmed recirculation of the sanitizing agent. Automated fill control with level sensors and power drain features are provided.

10 Claims, 6 Drawing Sheets

AUTOMATED PEDICURE SYSTEM

BACKGROUND OF THE INVENTION

1. Field of the Invention

The present invention pertains to pedicure treatment systems and in particular to such systems providing automated operation in a commercial environment.

2. Description of the Related Art

It has long been recognized that treatment of a persons feet can provide therapeutic relief to various points throughout the body. It is important, for example, to provide good blood flow through the feet and legs, especially for those people who must stand or otherwise remain immobile for long periods of time. Increasing attention is also being paid to good foot care by those who are interested in controlling the aging process. Recently, a number of consumer appliances have been proposed to bathe or massage a persons feet. Such appliances, intended for personal use, are of relatively lightweight construction and do not have the features necessary for commercial operation, particularly continuous operation for multiple users. Commercial operations such as those carried out at spas and medical clinics provide treatment for a number of people throughout the course of a working day. It is important that commercial pedicure equipment be quickly and easily sanitized and reset for a new cycle of operation when the equipment is made ready for the next user. While commercial pedicure stations offering pedicure treatment have been made available, the need for improved automated operation and flexible preprogrammed operating cycles would offer a further improvement in the industry.

SUMMARY OF THE INVENTION

It is an object of the present invention to provide a pedicure treatment system suitable for automated operation in a commercial environment.

A further object of the present invention is to provide a pedicure treatment system with self-cleaning operation throughout the course of a working day and/or less frequent periodic intervals.

A further object of the present invention is to provide a pedicure treatment system with onboard metering of sanitizing fluid from a bulk supply.

Yet another object of the present invention is to provide a pedicure treatment system offering recirculation of treatment fluid, with a volume of treatment fluid sufficient to maintain immersion of a persons feet throughout the course of the treatment cycle.

Yet another object of the present invention is to provide a pedicure treatment system having automated level control of the treatment chamber at the beginning and throughout the course of a treatment cycle.

A further object of the present invention is to provide a pedicure treatment system which can carry out a number of required system operations utilizing either one or two pumps for recirculation and mixing, as well as draining the treatment chamber.

Yet another object of the present invention is to provide a pedicure treatment system of the above-described type having automated control of the various system components, cooperating so as to provide different modes of improved systems operation.

Yet another object of the present invention is to provide a pedicure treatment system having multiple automated self-cleaning modes of operation.

These and other objects according to principles of the present invention are attained in a pedicure treatment system, which comprises a receptacle for immersion of the users feet in a treating fluid. A recirculating circuit coupled to the receptacle for recirculating treating fluid through the receptacle. A selectably operable main pump coupled to recirculating circuit to move treating fluid through recirculating circuit and receptacle. A source of treating fluid. A treating fluid valve coupled to source of treating fluid and recirculating circuit. A level sensor for controlling the level of treating fluid in receptacle. A fill control operably connected to treating fluid valve and level sensor to open and close treating fluid valve in response to level sensor, thereby controlling the level of treating fluid in receptacle. A selectably operable drain communicating with the receptacle to remove treating fluid from receptacle; a selectably operable drain pump coupled to the drain positively displacing treating fluid being drained from receptacle. A drain control operably connected to drain and drain pump to open and close drain and to energize drain pump to selectably positively displace contents of receptacle. A source of sanitizing solution. A selectably operable metering pump coupled to source of sanitizing solution and recirculating circuit for metering amounts of sanitizing solution into recirculating circuit. A sanitizing fill control operably connected to metering pump to energize and de-energize metering pump to selectably introduce sanitizing solution into receptacle.

Further objects according to principles of the present invention are attained in a pedicure treatment system, which comprises a receptacle for immersion of the users feet in a treating fluid. A recirculating circuit coupled to the receptacle for recirculating treating fluid through the receptacle. A selectably operable receptacle outlet coupled to the receptacle for removing the contents thereof. A drain circuit coupled to the receptacle outlet for directing contents of the receptacle away from the receptacle. A selectably operable main pump having an inlet coupled to receptacle outlet and an outlet. A selectably operable drain-recirculating valve coupled to main pump outlet, drain circuit and recirculating circuit to selectably direct output from main pump to one of drain circuit and recirculating circuit. A source of treating fluid. A treating fluid valve coupled to source of treating fluid and recirculating circuit. A level sensor for controlling the level of treating fluid in receptacle. A fill control operably connected to treating fluid valve and level sensor to open and close treating fluid valve in response to level sensor, thereby controlling the level of treating fluid in receptacle. A drain control operably connected to receptacle outlet and main pump to open and close receptacle outlet, to energize main pump and to operate drain-recirculating valve to selectably positively discharge contents of receptacle to drain circuit. A source of sanitizing solution; a selectably operable metering pump coupled to source of sanitizing solution and recirculating circuit for metering amounts of sanitizing solution into recirculating circuit and a sanitizing fill control operably connected to metering pump to energize and de-energize metering pump to selectably introduce sanitizing solution into receptacle.

DETAILED DESCRIPTION OF THE PREFERRED EMBODIMENTS

Figure 7:
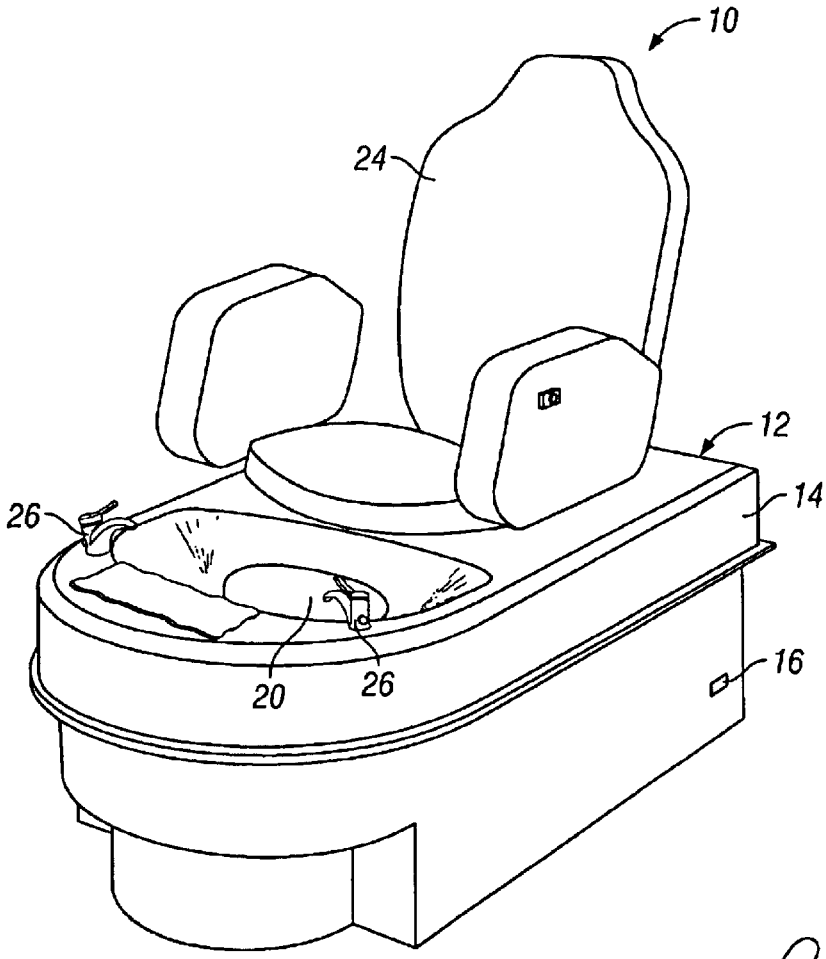
FIG. 7 is a perspective view of a pedicure treatment system according to principles of the present invention.
Figure 8:
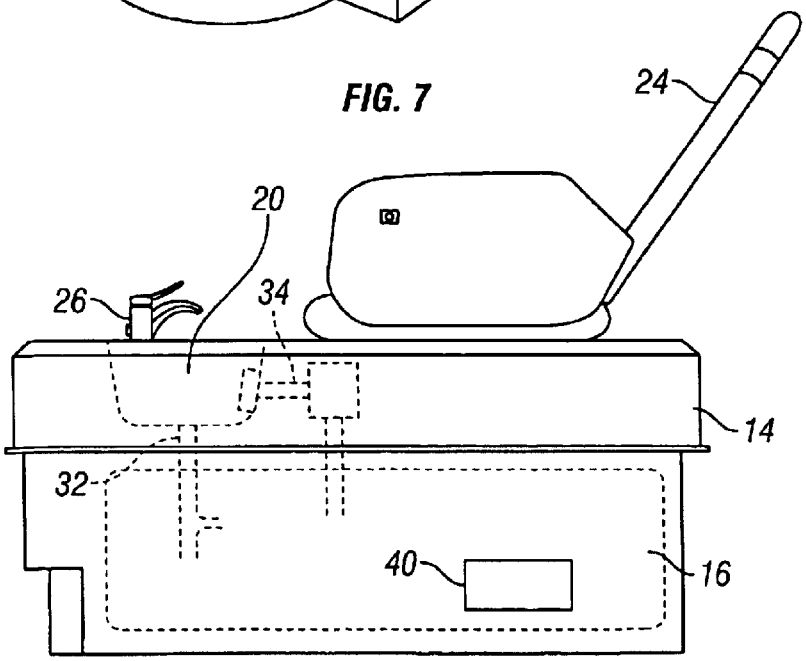
FIG. 8 is a cross-sectional schematic view of the system of FIG. 7.

Turning now to FIGS. 7 and 8 a pedicure treatment system according to principles of the present invention is generally indicated at 10. The pedicure treatment system, as will be seen herein, is especially suitable for continuous commercial use, accommodating a serial succession of users throughout the course of a business day. System 10 includes a housing 12 having an upper housing portion 14 and a lower housing portion 16. A receptacle 20 is located alongside a seat 24, mounted to upper housing portion 14. A user occupying seat 24 is conveniently disposed for immersion of their feet in receptacle 20. A number of controls 26 are provided for management of fluids contained in receptacle. Although system 10 could be operated in a quiescent or non-jetted mode, it is generally preferred that a recirculation system be provided to move fluids within receptacle 20 with a jet action. Mechanical and plumbing systems for re-circulation and other operations are located within lower housing 16. With reference to FIG. 8, included are a drain or receptacle outlet 32 and a re-circulating circuit 34 operating under control of a micro-computer or other programmable logic device indicated at 40.

Figure 1:
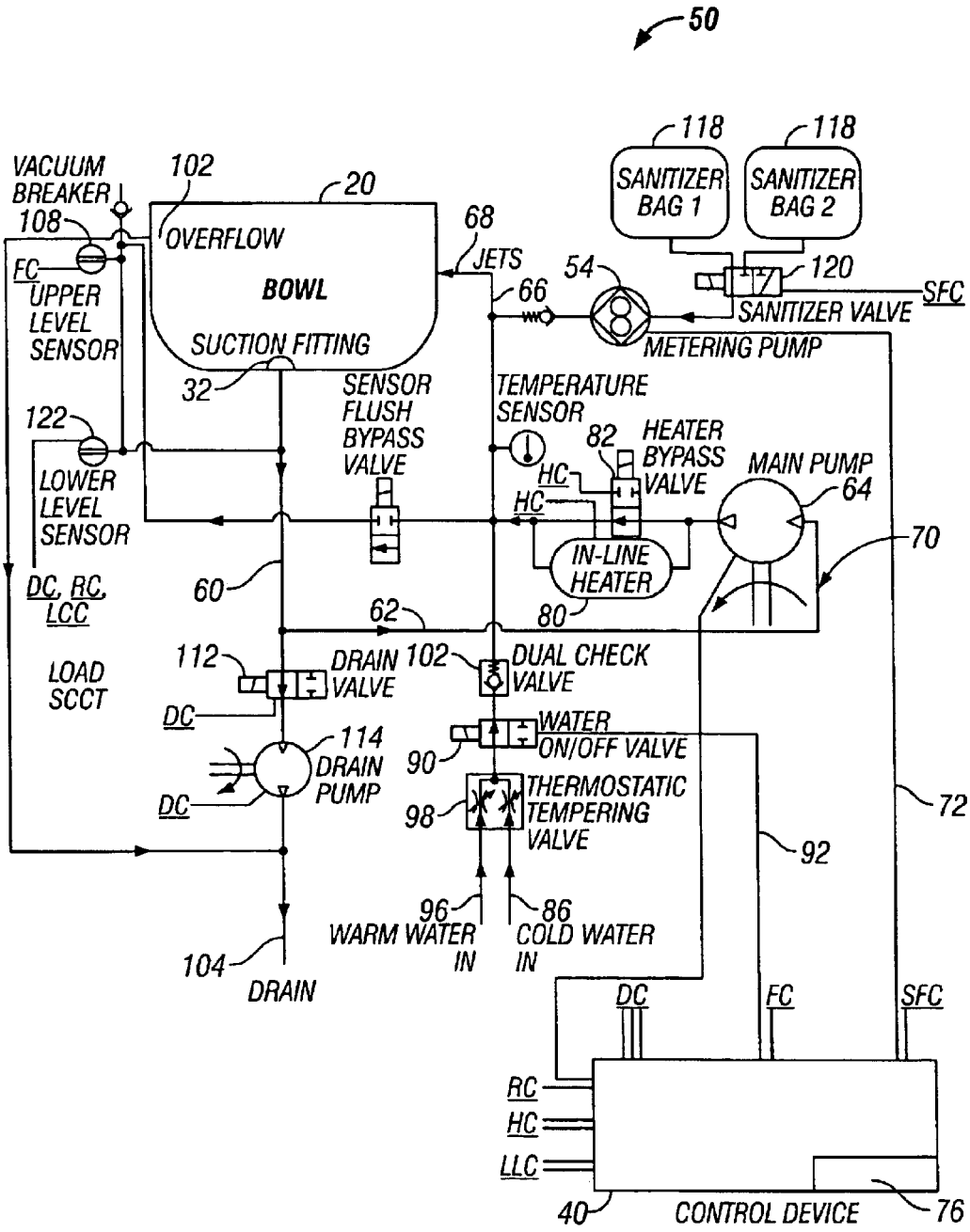
FIG. 1 is a schematic diagram of a dual pump pedicure treatment system according to principles of the present invention.

Turning now to FIG. 1, a first embodiment of a pedicure treatment system 50 is shown. System 50, among other features, includes a pair of operating pumps in addition to a metering pump 54. A drain or receptacle outlet 32 is coupled through connector sections 60, 62 to a main pump 64. The outlet of main pump 64 is coupled through conduit section 66 to jetted fittings 68 coupled to bowl 20. Together, conduit sections 60, 62 and 66 comprise a re-circulating circuit generally indicated at 70. Main pump 64 operates to re-circulate or move fluid through circuit 70 and receptacle 20.

A programmable controller device 40, preferably in the form of a micro-computer, is provided to perform certain control operations for system 50, as will be seen herein. For example, metering pump 54 is coupled through control circuit 70 to a sanitizing fill control terminal SFC of control device 40. Included within control device 40 is a device portion 76 including sanitizing control, refill control and periodic sanitizing control features which communicate with the various input/output ports including drain control (DC), fill control (FC), sanitary fill control (SFC), recirculation control (RC), heat control (HC) and low level control (LLC) ports.

Referring again to FIG. 1, an optional heater 80 and heater bypass valve 82 couple the output of main pump 64 to conduit section 66. As indicated, heater 80 and heater bypass valve 82 are coupled to heater control ports HC of control device 40. Under control of device 40 the output of main pump 64 can be selectively routed through heater 80 to heat fluid entering receptacle 20 through conduit section 66. Alternatively, control device 40 can operate heater bypass valve 82 to divert output of main pump 64 directly to conduit section 66. If desired, control device 40 can de-energize heater 80 while operating in the bypass mode.

Treating fluid used to fill receptacle 20 can be provided in a number of conventional arrangement. However, it is generally preferred that potable water be provided through fluid conduit section 86. Flow of treatment fluid through conduit section 86 is controlled by selectively operable treating fluid valve 90 which is coupled through control circuit 92 to the fill control port FC of control device 40. Optionally, the treating fluid source may include a warm water input 96 coupled to treating fluid valve 90 through a thermostatic tempering valve 98. Preferably a dual check valve 102 is coupled to the output of treating fluid valve 90. Thus, under operation of control device 40 appropriate signals are sent through connector circuit 92 to open valve 90, filling receptacle 20 with treating fluid. Virtually any type of treatment fluid may be used in carrying out the present invention. Preferably, the treating fluid comprises water without the presence of special purpose additives, although other conventional fluids could be used as desired.

With valve 90 in an open position, treating fluid enters receptacle 20 and if sufficiently high levels of treating fluid are retained in receptacle 20, excess fluid exits through overflow outlet 102, passing through drain circuit 104. Preferably, before over flow conditions are reached, an upper level sensor 108 sends an over flow signal through the indicated control circuit to the fill control port FC of control device 40. Control device 40, upon presence of an over flow signal, sends a control signal to close valve 90.

Emptying of receptacle 20 is accomplished by opening drain valve 112, which is coupled through conduit section 60 and receptacle outlet 32 to the interior of receptacle 20. As indicated in FIG. 1, drain valve 112 is coupled through a control circuit to drain control port DC of control device 40. Control circuits also couple a drain pump 114 to drain control port DC of control device 40. The control device 40 sends appropriate control signals to valve 112 and pump 114 for positive discharge of the contents of receptacle 20 to drain circuit 104.

As mentioned, metering pump 54 operates under control of sanitary fill control port SFC of control device 40. A source of sanitizing solution 118 passes through a sanitizer valve 120 to the input of metering pump 54. With valve 120 in an open position and metering pump 54 energized, metered amounts of sanitizing fluid are introduced into conduit section 66 mixing with treating fluid from source 86 according to a prescribed ratio. The desired concentration of sanitizing solution is introduced into receptacle 20, and optionally, is circulated through the recirculation circuit 70.

In operation, at the start of a business day, an operator sends a start command to control device 40. In response, control device 40 opens valve 90 allowing treating fluid from source 86 to enter into receptacle 20. Filling of receptacle 20 continues until upper level sensor 108 sends a signal to fill control port FC of control device 40. In response, control device 40 sends a signal to valve 90, closing the valve. If desired, a user in seat 24 (see FIG. 7) can enjoy an immersion treatment bath by immersing the users feet in treating fluid contained in receptacle 20. It is recognized that a user may wish to have a whirlpool or jet action added to the immersion experience. Accordingly, control device 40 may be set to automatically initiate re-circulation or a separate control may be provided for the operator of system 50. In either event, any selectably operable feature of receptacle outlet or drain 32 can be invoked to open the receptacle outlet and main pump 64 is energized to draw treating fluid from receptacle 20, re-circulating the treating fluid through conduit section 66 and jet fitting 68 to provide a whirlpool action within receptacle 20. If heating of the recirculating treating fluid is desired, control device 40 can be set to provide automatic temperature sensing with operation of inline heater 80 as may be required to achieve a desired elevated operating temperature. If desired, operation of the heater may be temporarily or permanently discontinued by opening heater bypass valve 82 under control of device 40.

Preferably, the quiescent immersion mode, or re-circulating whirlpool mode continues for a selectable pre-set time period, set within control device 40. At the end of the treatment period, pump 64 is deactivated. Next, after a preferred time delay the contents of receptacle 20 are emptied. As mentioned, the drain or receptacle outlet 32 may include a remotely control valving operation or alternatively may provide a simple open connection to conduit section 60. Control device 40 sends appropriate signals to open drain valve 112 and energize pump 114, positively discharging the contents of receptacle 20 to drain circuit 104. It is generally preferred that the input and output to main pump 64 and the output of metering pump 54 be allowed to drain through valve 112, so as to be positively discharged by pump 114 into drain circuit 104.

As mentioned, the pedicure treatment system 50 is particularly suitable for use in a commercial continuous application. A positive discharge provided by drain pump 114 aids in speeding the clearance of fluids from system 50 at the end of an initial user cycle, readying the system for a subsequent user cycle. Although receptacle 20 could be immediately filled with treating fluid, it is generally preferred that a brief inter-user sanitizing cycle be initiated. The inter-user sanitizing cycle, carried out under operation of control device 40, can simply rinse system 50 with the introduction of treating fluid from source 86 into receptacle 20, with or without optional re-circulation carried out by pump 64. The rinse operation could be carried out with a partial level within receptacle 20, but preferably is carried out that the full immersion depth of receptacle 20, under control of upper level sensor 108. Most preferably, control device 40 opens sanitizer valve 120 and energizes metering pump 54 so as to introduce a desired concentration of sanitizing fluid from source 118. The diluted sanitizing solution can be introduced so as to fill receptacle 20 to its full immersion depth, as indicated by upper level sensor 108. Preferably, main pump 64 is briefly operated to circulate sanitizing solution through the re-circulation circuit. The sanitizing solution is then discharged by the operation of pump 114. A rinsing cycle of the type described above may be subsequently employed. Operation of the inter-user sanitizing cycle will be described herein in greater detail with reference to FIGS. 3 and 4.

If desired, a lower level sensor 122 may be coupled to conduit section 60 to sense a low level or absence of treating fluid in receptacle 20. As indicated in FIG. 1, lower level sensor 122 is coupled to the drain control port DC, re-circulation control port RC and lower level control port LLC of control device 40. In operation during a re-circulating cycle, lower level sensor 122 can be employed to protect main pump 64, preventing its operation in the absence of a sufficient amount of fluid at its pump inlet. When operating in a drain control mode, lower level sensor 122 can signal the early stages of termination of the drain control event, triggering a time delay in control device 40 after which the drain valve 112 is closed and drain pump 114 is de-energized. In a lower level control mode, lower level sensor 122 provides control information to control device 40 through lower level control port LLC.

Figure 2:
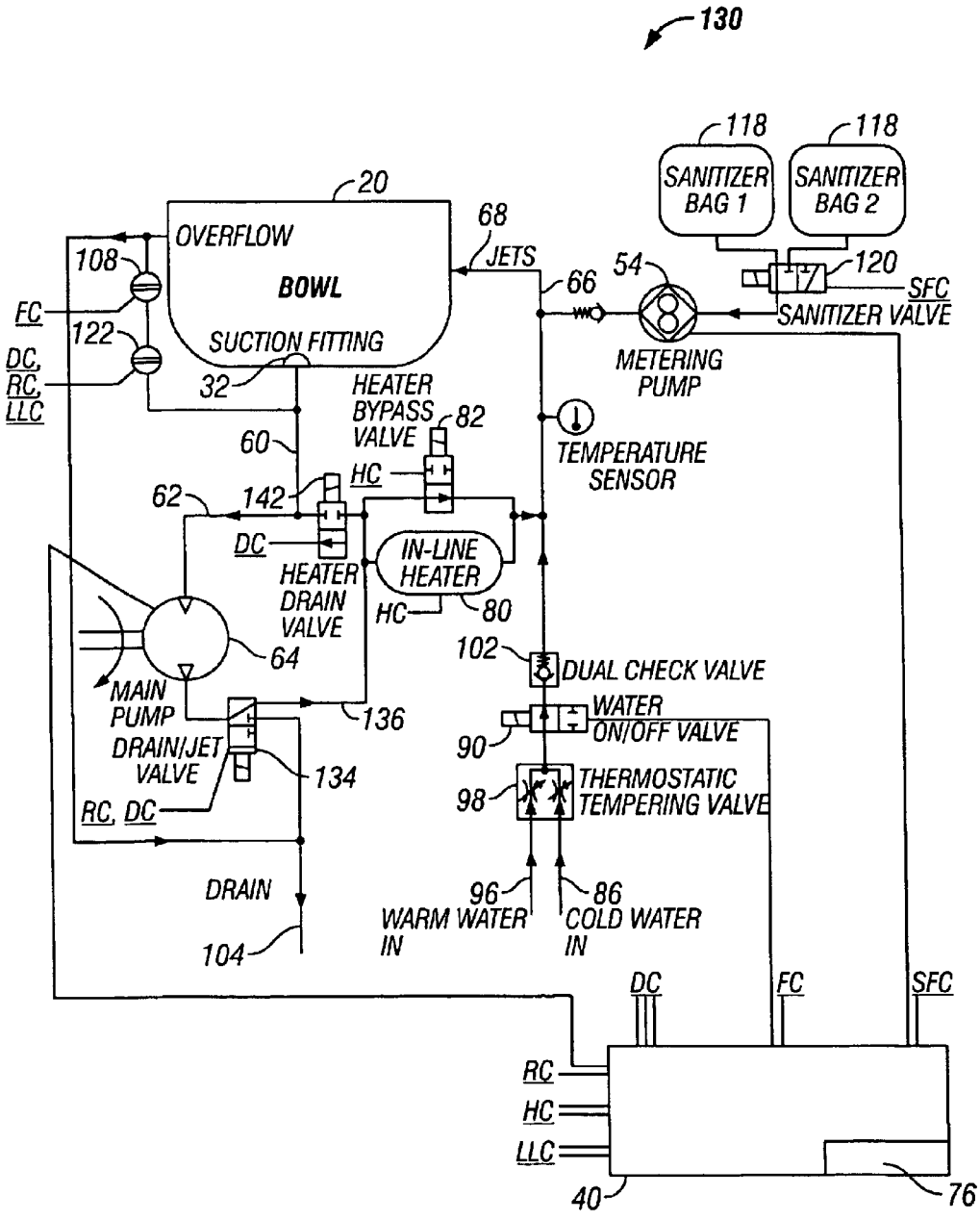
FIG. 2 is a schematic diagram of a single pump pedicure treatment system according to principles of the present invention.

Turning now to FIG. 2, a pedicure treatment system is generally indicated at 130. System 130 shares many of the same features as system 50, described above, but a single main pump provides both re-circulation and drain functions. As shown in FIG. 2, the inlet of main pump 64 is coupled through conduit sections 60 and 62 and receptacle outlet 32 to the interior of receptacle 20. The output of main pump 64 is coupled to a drain/re-circulating valve 134 which has outputs coupled to drain circuit 104 and a conduit section 136. Conduit section 136 couples/drains re-circulating valve 134 to inline heater 80 or heater bypass valve 82 which are operated as described above to provide selected heating to the contents of receptacle 20. As indicated in FIG. 2, drain/re-circulating valve 134 is coupled to drain control port DC and re-circulation control port RC of control device 40. When drain control operation is called for, valve 134 is operated to route the output of main pump 64 to drain circuit 104. When recirculation operating mode is desired, valve 134 is operated under control of device 40 to route the output of main pump 64 through the heater 80 and heater bypass valve 82 which in turn are coupled through conduit section 66 and jet fitting 68 to the interior of receptacle 20.

In a drain control event, a signal is sent from drain control port DC of control device 40 to a heater drain valve 142, coupling the heater and heater bypass valve circuits to the input of pump 64, thus providing positive discharge to drain circuit 104.

Figure 3:
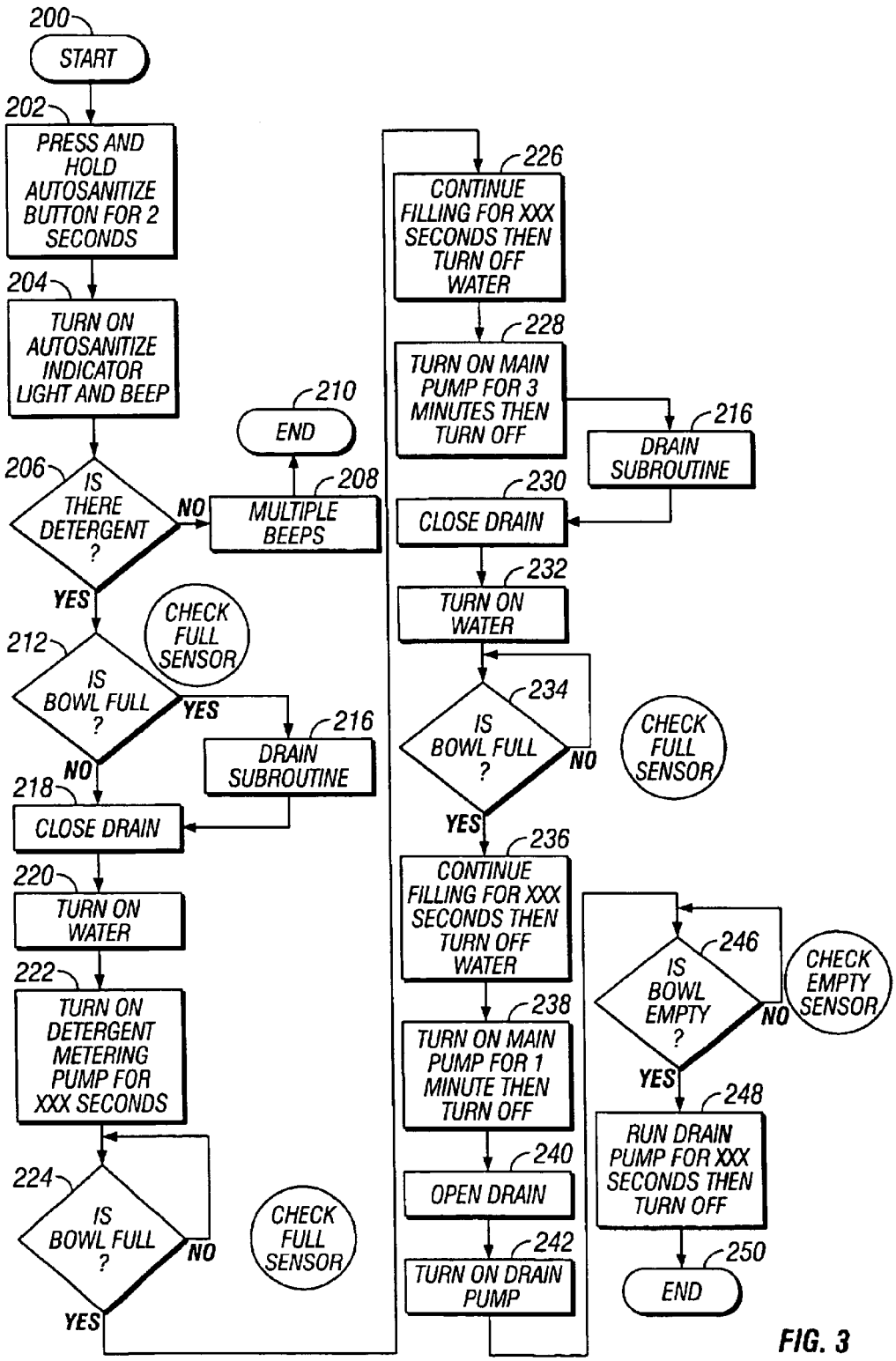
FIGS. 3 and 4 together comprise a flow diagram of a first auto-sanitizing operation.
Figure 4:
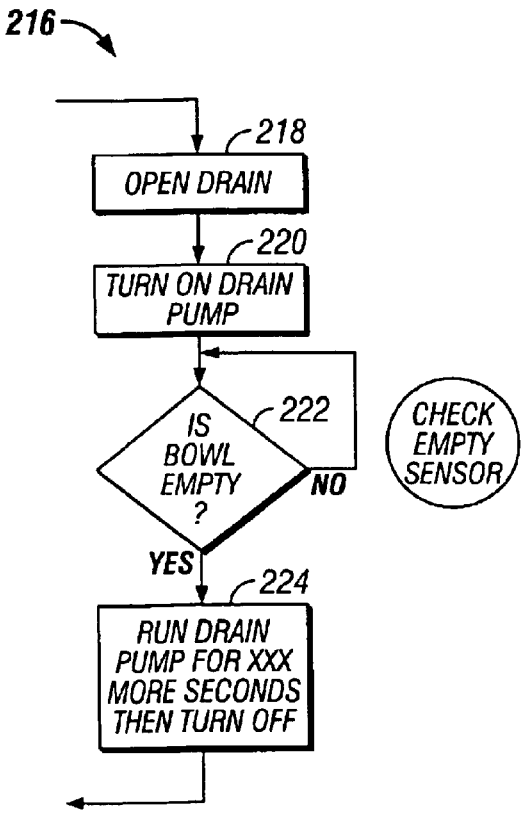

Turning now to FIGS. 3 and 4, operation of an inter-user sanitizing routine for control device 40 is illustrated. Referring initially to FIG. 3, control is initiated at start block 200 after setting of initial values and clearing registers or the like. Control is passed to block 202 which waits to receive operation of an AUTO-SANITIZE switch for a predetermined period of time, sufficient to confirm an intentional switch activation. In response, in block 204 an auto-sanitizing indicator light on the operator's control panel is energized and an audible alert is sounded. If desired, control blocks 200-204 can be replaced with an automated link to circuitry within control device 40 indicating that a current user treatment session has ended. Preferably, receptacle 20 is drained and optionally rinsed before control is passed to decision block 206 which verifies that sanitizing solution is present in source 118. If insufficient sanitizer fluid is detected, control is passed to block 208 providing a suitable audible or other type of communication to the operator, and operation is ceased at control block 210.

Assuming presence of sanitizing fluid in source 118, decision block 206 passes control to decision block 212. As indicated alongside decision block 212, a query may be made of the over flow sensor to determine whether the receptacle 20 is filled to a full immersion level. Other types of receptacle level sensing can be employed, if desired. If receptacle 20 is indicated as containing a fluid level, control is passed to block 216 which comprises the drain sub routine shown in FIG. 4.

Referring to FIG. 4, a drain sub routine 216 control is passed to block 218 which opens the drain connections to receptacle 20. The drain pump is then energized in control block 220. In the dual pump system described above in FIG. 1, under operation of control block 220, drain valve 112 is opened and drain pump 114 is energized. In the pedicure treatment system 130 described above in FIG. 2, main pump 64 is energized and valve 134 is operated to direct the discharge of pump 64 to drain circuit 104. A polling operation is carried out in block 222 to periodically verify whether the drain operation has been completed. As indicated in the symbol next to control block 222, the lower level sensor 122 can be interrogated to verify the absence of fluid. Alternatively, other conventional means may be employed to assure that any continued remaining trickling amounts of fluid are positively discharged.

Turning again to FIG. 3, upon successful completion of drain sub routine 216, control is passed to block 218 which re-sets the drain equipment. In the system of FIG. 1, drain valve 112 is closed and drain pump 114 is de-energized. In the system of FIG. 2, main pump 64 is de-energized and valve 134 is set to direct pump output to the heater/heater bypass valve circuit. Control is then passed to block 220 to charge the system with sanitizing solution.

In block 220 the supply of treating fluid is introduced into receptacle 20, preferably by opening valve 90. In block 222 the metering pump 54 is energized and sanitizer valve 120 is opened. The combined action of control blocks 220, 222 provides a supply of sufficiently diluted sanitizing solution within receptacle 20. A poling operation is carried out in block 224 until receptacle 20 is filled. As indicated by the symbol next to control block 224, filling of receptacle 20 may be indicated by the condition of upper level sensor 108. In block 226 filling is continued for a pre-selected time period to ensure complete filling, despite any erratic sensor conditions.

Control is then passed to block 228 to re-circulate sanitizing solution in the recirculating circuit and receptacle. Operation under control block 228 continues for a pre-selected time period. Control is then passed to the drain sub-routine of FIG. 4 and the drain closing operation is carried out in control block 230, which is preferably substantially identical to control block 218 described above.

A rinsing cycle is then initiated with passage of control to block 232. After treating fluid is introduced into receptacle 20, control is passed to decision block 234 whose operation is substantially identical to decision block 224. Filling is continued in control block 236 in the manner described above with reference to control block 226. Re-circulation is then carried out in control block 238 for a time period which is programmed in control device 40. Preferably, this time period is substantially less than that of control block 228. For example, the control time periods of blocks 228 and 238 are three-minutes and one-minute, respectively.

Figure 6:
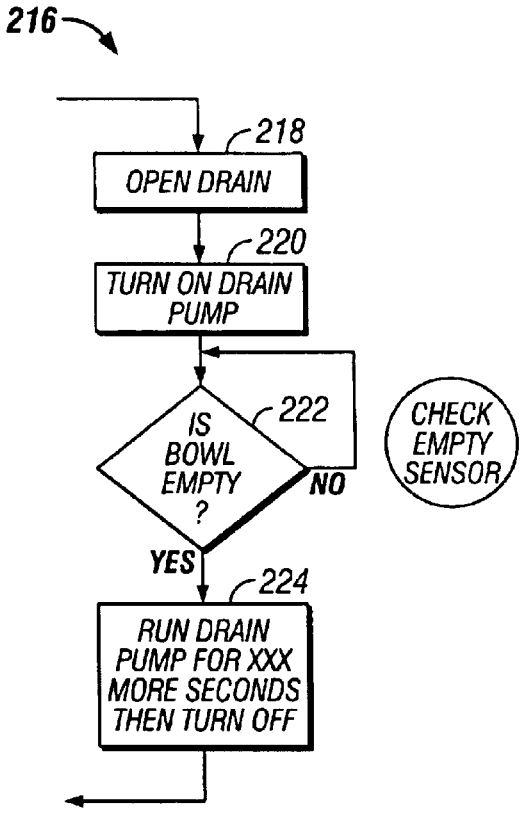
FIGS. 5 and 6 together comprise a flow diagram of another auto-sanitizing operation according to principles of the present invention.
Figure 5:
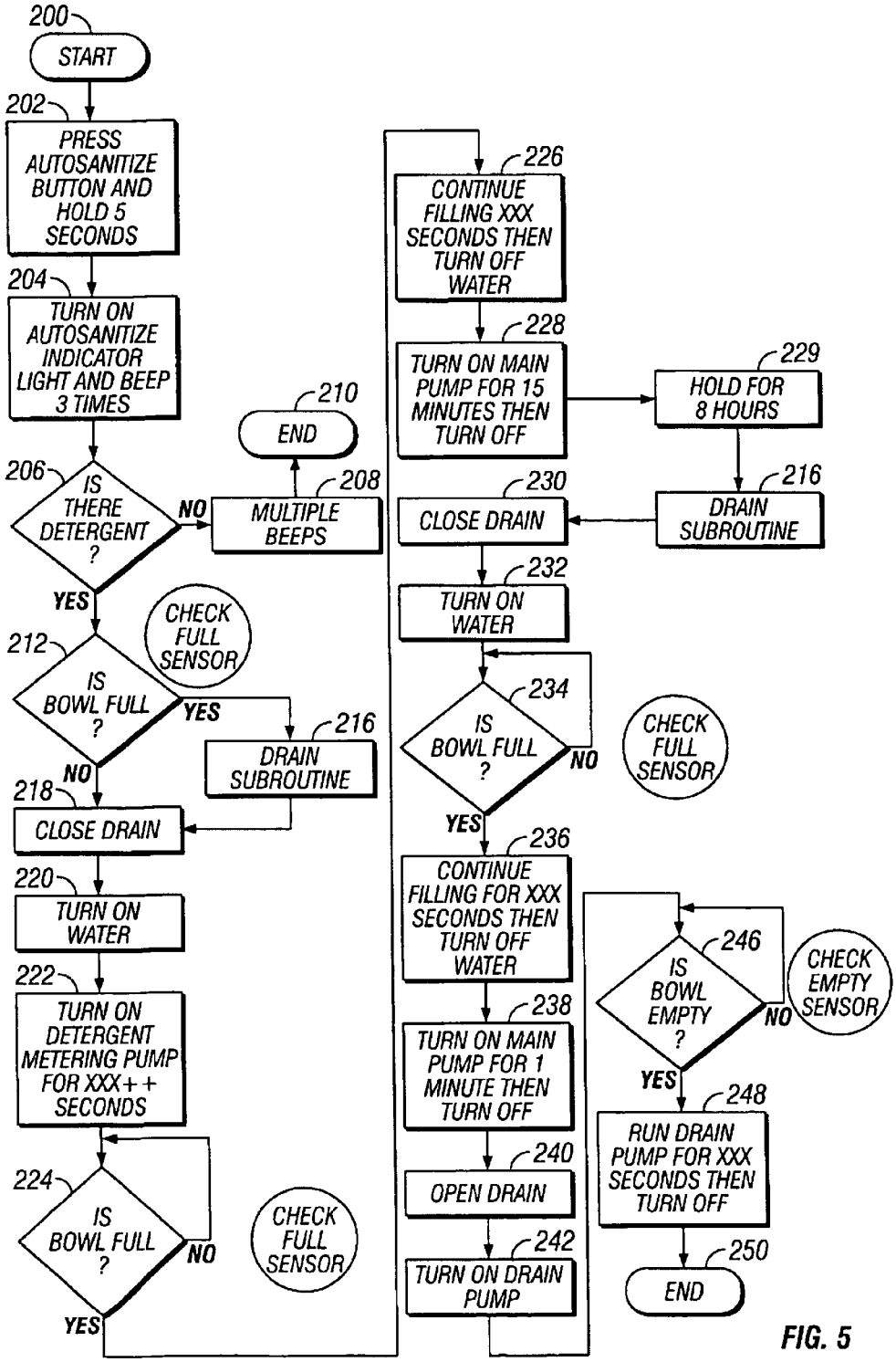

Next, in control block 240 and 242 the conduit sections coupled to the receptacle outlet are opened to the drain pump and the drain pump is energized. Operation of the drain pump continues under control of decision block 246 until an empty drain condition is detected. In block 248 the drain pump continues to operate for a pre-determined time delay to assure that any remaining quantities of fluid are positively discharged. Control is then terminated in block 250. Turning now to FIGS. 5 and 6, a periodic sanitizing control is described. As can be seen by comparing FIGS. 5 and 6 to FIGS. 3 and 4 described above, the periodic sanitizing control of FIGS. 5 and 6 is substantially identical to the inter-user control of FIGS. 3 and 4. Referring to control block 228 of FIG. 5, the periodic sanitizing control is intended to be carried out at regular intervals. The periodic sanitizing control is preferably carried out at the end of an appointed business day so as to accommodate the holding control of block 229 prior to initiation of a second drain sub-routine 216 interposed between control blocks 229 and 230 of FIG. 5.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A pedicure treatment system, comprising:

a receptacle for immersion of the users feet in a treating fluid;

a recirculating circuit coupled to the receptacle for recirculating treating fluid through the receptacle;

a selectably operable main pump coupled to said recirculating circuit to move treating fluid through said recirculating circuit and said receptacle;

a source of treating fluid;

a treating fluid valve coupled to said source of treating fluid and said recirculating circuit;

a level sensor for controlling the level of treating fluid in said receptacle;

a fill control operably connected to said treating fluid valve and said level sensor to open and close said treating fluid valve in response to said level sensor, thereby controlling the level of treating fluid in said receptacle;

a selectably operable drain communicating with the receptacle to remove treating fluid from said receptacle;

a selectably operable drain pump coupled to the drain positively displacing treating fluid being drained from said receptacle;

a drain control operably connected to said drain and said drain pump to open and close said drain and to energize said drain pump to selectably positively displace contents of said receptacle;

a source of sanitizing solution;

a selectably operable metering pump coupled to said source of sanitizing solution and said recirculating circuit for metering amounts of said sanitizing solution into said recirculating circuit; and a sanitizing fill control operably connected to said metering pump to energize and de-energize said metering pump to selectably introduce sanitizing solution into said receptacle.

2. The system of claim 1 further including a recirculating control operably connected to said main pump to move sanitizing solution through said recirculating circuit and said receptacle.

3. The system of claim 1 further including a sanitizing control including time delay means operably connected to said drain control to retain sanitizing solution in said receptacle for a preselected time period.

4. The system of claim 3 wherein said sanitizing control further including a recirculating control operably connected to said main pump to move sanitizing solution through said recirculating circuit and said receptacle.

5. The system of claim 3 wherein said sanitizing control is also operably connected to said treating fluid valve, to combine treating fluid and sanitizing fluid in said receptacle.

6. The system of claim 1 further comprising heating means coupled to said recirculating circuit to heat material traveling through said recirculating circuit.

7. The system of claim 1 further comprising a low level control for de-energizing said main pump in response to a low level condition being detected in said receptacle.

8. The system of claim 1 further comprising a seat beside said receptacle for seating a user for immersion of the user's feet in the receptacle.

9. The system of claim 1 further comprising a refill control for refilling the receptacle for a subsequent user upon finish of treatment of an initial user, comprising:

an inter-user sanitizing control operatively coupled to said sanitizing fill control to introduce sanitizing solution into said receptacle and to retain the sanitizing solution in said receptacle for a predetermined time;

said inter-user sanitizing control operatively coupled to said fill control to introduce a rinse of treating fluid into said receptacle;

said inter-user sanitizing control operatively coupled to said drain control to positively displace the rinse of treating fluid from said receptacle; and said inter-user sanitizing control also operatively coupled to said fill control to fill said receptacle with an immersion level of treating fluid from said source of treating fluid.

10. The system of claim 1 further comprising a periodic sanitizing control;

said periodic sanitizing control operatively coupled to said sanitizing fill control to introduce sanitizing solution into said receptacle and to retain the sanitizing solution in said receptacle for a predetermined time;

said periodic sanitizing control operatively coupled to said fill control to introduce a rinse of treating fluid into said receptacle and said recirculating circuit;

said periodic sanitizing control operatively coupled to said main pump to move treating fluid through said recirculating circuit and said receptacle; and said periodic sanitizing control operatively coupled to said drain control to positively displace the rinse of treating fluid from said receptacle.

* * * * *